US009820589B2

(12) United States Patent
Coote

(10) Patent No.: US 9,820,589 B2
(45) Date of Patent: Nov. 21, 2017

(54) HANGER

(71) Applicant: The Janger Limited, London (GB)

(72) Inventor: John Coote, Essex (GB)

(73) Assignee: The Janger Limited, London (GB)

( * ) Notice: Subject to any disclaimer, the term of this patent is extended or adjusted under 35 U.S.C. 154(b) by 0 days.

(21) Appl. No.: 14/639,472

(22) Filed: Mar. 5, 2015

(65) Prior Publication Data

US 2015/0173532 A1 Jun. 25, 2015

Related U.S. Application Data

(63) Continuation of application No. 13/521,867, filed as application No. PCT/GB2011/050046 on Jan. 13, 2011, now Pat. No. 8,994,535.

(30) Foreign Application Priority Data

Jan. 13, 2010 (GB) ..... 1000483.6
Sep. 10, 2010 (GB) ..... 1015123.1

(51) Int. Cl.

| | |
|---|---|
| ***A41D 27/22*** | (2006.01) |
| ***A47F 7/19*** | (2006.01) |
| ***A47G 25/00*** | (2006.01) |
| ***A47G 25/14*** | (2006.01) |
| ***A47G 25/74*** | (2006.01) |
| ***B65D 73/00*** | (2006.01) |
| ***A47F 5/00*** | (2006.01) |

(52) U.S. Cl.

CPC ..... *A47F 7/19* (2013.01); *A47F 5/00* (2013.01); *A47G 25/005* (2013.01); *A47G 25/1442* (2013.01); *A47G 25/743* (2013.01); *B65D 73/0064* (2013.01); *Y10T 29/49826* (2015.01)

(58) Field of Classification Search

CPC .... A47G 25/74; A47G 25/743; A47G 25/005; A47G 25/1457; A47F 7/19; A47F 5/00

USPC ..... 223/87

See application file for complete search history.

(56) References Cited

U.S. PATENT DOCUMENTS

| | | | | | |
|---|---|---|---|---|---|
| 1,510,915 | A | * | 10/1924 | Bartholdi | 223/87 |
| 3,592,343 | A | * | 7/1971 | Swett | A47G 25/743 211/113 |
| 3,685,189 | A | * | 8/1972 | Conger | A47G 25/28 223/95 |
| 4,023,762 | A | * | 5/1977 | Batts | A47G 25/32 211/113 |
| 5,222,638 | A | | 6/1993 | Kolton | |
| 5,584,455 | A | * | 12/1996 | Artemi | A47G 25/1457 211/113 |

(Continued)

FOREIGN PATENT DOCUMENTS

| | | |
|---|---|---|
| EP | 0 771 922 | 5/1997 |
| FR | 2 714 103 | 6/1995 |

OTHER PUBLICATIONS

International Search Report for corresponding Patent Application No. PCT/GB2011/050046 dated Apr. 13, 2011.

*Primary Examiner* — Nathan Durham

(74) *Attorney, Agent, or Firm* — Renner, Otto, Boisselle & Sklar, LLP

(57) ABSTRACT

The present invention discloses a device for hanging clothes, comprising an engaging portion and a deformable elongate member, the elongate member comprising a connection mechanism such that the elongate member can be deformed back upon itself and connected to itself to form a loop.

3 Claims, 2 Drawing Sheets

(56) References Cited

U.S. PATENT DOCUMENTS

| | | | | |
|---|---|---|---|---|
| 5,615,810 | A * | 4/1997 | Kolton et al. | 223/85 |
| 6,299,039 | B1 | 10/2001 | Hsu | |
| 7,015,815 | B1 | 3/2006 | Feibelman | |
| 8,994,535 | B2 * | 3/2015 | Coote | A47G 25/005 223/85 |
| 2002/0033403 | A1 * | 3/2002 | Bennett | A47F 7/12 223/87 |
| 2004/0217249 | A1 | 11/2004 | Eisenbraun | |
| 2005/0099303 | A1 | 5/2005 | Zuckerman | |
| 2007/0125811 | A1 * | 6/2007 | Oliveira-Martinez | A47F 5/0006 223/85 |
| 2015/0245724 | A1 * | 9/2015 | Sut | A47G 25/28 223/88 |

* cited by examiner

HANGER

This application is a continuation of U.S. patent application Ser. No. 13/521,867 filed Sep. 14, 2012, which is a U.S. National Phase of International Application No. PCT/GB2011/050046 filed Jan. 13, 2011, which claims priority to United Kingdom Application Number 1015123.1 filed Sep. 10, 2010 and United Kingdom Application Number 1000483.6 filed Jan. 13, 2010, which are all hereby incorporated herein by reference in their entirety.

FIELD OF THE INVENTION

This invention relates to a hanger.

BACKGROUND TO THE INVENTION

Existing hangers for garments generally comprise a base member that is generally horizontal when in use, and this mimics shoulders in the case of tops and jackets. Alternatively, the horizontal base member is used to support trousers, skirts and shorts either at the waist band, often supported by a clip mechanism, or by folding the garment and resting it on the member, especially in the case of trousers.

Various disadvantages exist with such hangers. For example, the neck of a top may be sufficiently wide for the garment to slip off the hanger, especially if the garment is not put perfectly in the middle of the base member. Therefore, various different lengths of horizontal member are required and the right size must be chosen to avoid the garment falling off the hanger. Furthermore, fashion dictates some lower body garments are not enhanced by having fold lines, especially in the case of jeans or casual trousers. Therefore, it becomes a disadvantage to have to hang such garments in a way that creases may be formed. Also, if the user folds lower body garments badly before resting them on the hanger in a folded position, a double crease may form in the garment which is unsightly.

It is also the case that people are often lazy and do not take the time to fold their garments or hang them on a hanger with a horizontal member. Instead they put them in a drawer or on a shelf in an unfolded manner, creating creases in undesirable positions, making the wearer look untidy when they next wear the garment.

Further disadvantages occur with existing hangers both before the items are put on display for sale and after. For example, once clothing is delivered to a store, staff members have to take a considerable amount of time to unpack the items, put them on hangers and apply security tags. This process, especially the application of a hanger may need to be repeated each time a person tries on a garment, therefore taking up more of the sales assistant's time.

A further problem with existing systems is that the security tags often result in putting a hole in the item, albeit a small one, which may damage the item. Also, the security tag can catch on shelving or on people and their accessories and cause further damage to the item, especially when a potential customer is trying the item on.

High-end fashion items can be of considerable value and therefore it is desirable to avoid putting security tags on the clothing. However, should these items be stolen from a store, the losses may be significant.

SUMMARY OF THE INVENTION

According to a first embodiment, the present invention provides a device for hanging an item comprising a support-engaging portion and a deformable elongate member, the elongate member comprising a connection mechanism such that the elongate member can be deformed back upon itself and connected to itself to form a loop in such a way that when the elongate member is in its deformed state, a substantially flat spacer is defined at the intended lower end of the loop so that the item rests upon the flat spacer when in use.

By making a hanger to such a construction, the connecting member forms a loop that becomes substantially held in place. Many items of clothing, especially garments intended for the lower body comprise loops, often in the form of belt-loops. For casual trousers, for example jeans, it is preferably to not have folded or pressed creases in the garment. Therefore by hanging the trousers by way of a hanger threaded through itself to interlock with the belt-loop and being connected to itself, the casual trousers can be hung on a rail without causing undesirable creases. Therefore, the hanger can be substantially connected to an item by threading the attachment portion through the item, for example a belt loop or a hanging loop, and using the connecting member to form a substantially unreleasable loop. The item can then be hung on a support, such as a standard retail clothing rail, using the support engaging portion.

Clothes, including many jackets and coats, often comprise a hanging loop for hanging the garment on a coat peg or coat stand. The present invention may be threaded through such a loop and the garment hung using that loop. Furthermore, the washing instructions label or "size" label is often positioned at the back of neck on jumpers and other tops. The hanger may be threaded through those labels if there is not an intended hanging loop. In addition, sheets, cloths, gloves, hats, shoes, scarves and other items can be hung from the hanger.

Because a flat spacer, or shelf, is introduced to the hanger, the garment can rest on the spacer without deforming the material of the garment. For example, a belt loop can lay flat on the spacer, thereby reducing the risk of the loop deforming and damaging the material.

Such a device, or hanger, can be attached to clothing articles during manufacture, thereby reducing the amount of labour required by staff in a clothes store, because there is no need for them to attach hangers because as they unpack the clothing and put them directly on the shelves or rails using the pre attached hanger.

The attachment portion may be connected to the support engaging portion via a body portion. By connecting the attachment portion to the support engagement portion via a body portion, space is provided on the hanger for application of a logo or an indication of the size of the item. Also, the hanger is more robust and aesthetically appealing when a body portion is present.

It is preferably that the elongate member comprises at least one pre-determined weakened region. By having pre-determined weakened regions, the elongate member may be deformed in a particular way so as to form, for example a triangular loop, on which garments may be hung. The weakened regions make the loop easier to deform, thereby requiring less effort by the user. Additionally, the flat spacer can be more readily formed when the elongate member is provided with pre-determined weakened regions. Furthermore, the shape of the loop may be designed to relieve pressure on the connection member by forming a loop of a particular shape.

Advantageously, the engaging portion is in the form of a hook. Hooks are particularly compatible with standard retail clothing rails, and make putting the hanger on a rail or peg relatively easily. Alternatively, the engaging portion may be in the form of a loop. Hotels reduce the risk of hangers from being removed from the room by connecting a loop to a rail and having a detachable hanging part. By using a hanger according to the present invention and having a loop, the hanger does not necessarily need to be disconnected from the rail in order to hang a garment.

It is preferably that, the device further comprises at least one security tag. Because the device attaches to an item in a non-releasable fashion, incorporating a security tag within the device allows for the device to be used in existing clothing stores to reduce the risk of items being stolen. Additionally, the amount of labour required to put clothing out for sale is reduced by allowing for the hanger and security device to be attached at once, rather than having to attach them separately. Indeed, the security device and hanger may be applied by the clothing manufacturer, as mentioned above. Furthermore, there is no need to put a hole in the garment in order to attach the security device, thereby reducing the risk of the garment being damaged during application and removal of the security tag.

In one embodiment, the security tag is attached to, or at least partially embedded in, the hanger. Once the hanger is made, a security tag can be attached using adhesive. A recess may be left in the device to allow the security tag to be partially embedded and "centered" so that the security tag is always in a predetermined location on the device.

It is preferable that the security tag is wholly embedded within the device. This prevents parties from physically tampering with the device. Furthermore, by wholly embedding the security tag, the tag is hidden from view and one might assume that there is no security tag on the device. If the device is moulded from plastics materials, the security tag may be moulded into the device during manufacture.

Advantageously, the security tag is part of an electronic article surveillance system and wherein the type of tag is selected from a list comprising: magnetic (or magneto-harmonic) tag; acousto-magnetic (magnetostrictive) tag; radio-frequency tag; and microwave tag.

Alternatively, the security tag is microchip. By using a microchip, the device can provide more information, for example, the name of the owner of the hanger.

Preferably, the device may be adapted to be tracked by GPS technology to determine its location. For high-cost items it is desirable to be able to track the location of the hanger that is attached, in case the item is lost or stolen. By using known GPS technology, the device can be located.

It is advantageous if the attachment portion comprises reinforcement means to resist severing of the attachment portion. In order to reduce the risk of one removing the hanger from an item, reinforcement means can be used. By using reinforcement means, the likelihood of the device being removed in-store is reduced as a customer will have more difficulty in removing the device.

Preferably, the reinforcement means comprises metal wire embedded within the attachment portion. Metal wire, for example steel wire, is a cost effective method of reinforcing the device. Scissors are less likely to be able to cut through the device, thereby making it more resistant to removal by a thief.

In one construction, the connection mechanism is a substantially releasable connection, and, advantageously, the releasable connection is a snap-fit connector. It is preferable that the releasable connection is a snap-fit connector. By using a snap-fit connector, the loop is readily, quickly and easily releasable.

Alternatively, the connection mechanism may comprise a substantially unreleasable, or permanent, connection.

In one preferred embodiment, the connecting member comprises a split-click fastener mechanism. The mechanism may be a hemi-spherical, or "mushroom" topped, click-fastener with a split through the middle the hemi-spherical top. The top of the click-fastener is compressed together as an aperture is threaded onto the fastener. Once the aperture is over the top, or "mushroom head", of the click-fastener, the "head" or top expands outwardly again, preventing the aperture from passing back over the fastener, thereby making it substantially non-releasable. The head of the fastener may then be covered or concealed to prevent one from being able to readily attempt to compress the fastener and pass the aperture over the top once more.

Alternatively, the connecting member comprises a ratchet mechanism. Using a "cable-tie" or ratchet mechanism provides a cost-effective and simple to operate one-way connecting member. The receiving portion may be concealed to prevent one from attempting to release the teeth and reverse the connection.

The device may comprise a plurality of elongate members. By having more than one elongate member, multiple garments may be hung from a single hanger. In a construction having two elongate members, the members may be in the form of an inverted "Y" shape, with the two elongate members having an appreciable gap between them. Such a hanger may be used to hang a single garment, for example by being threaded through two belt loops of a pair of jeans. The garment is then more secure and can be better displayed, but, when the connection mechanism is substantially releasable, the garment remains readily releasable from the hanger.

The invention extends to a method of hanging a garment comprising the steps of:

threading a hanger as claimed in any preceding claim through a loop connected to a garment;

closing the releasable connection mechanism; and using the engaging portion to hang the garment.

BRIEF DESCRIPTION OF THE DRAWINGS

An embodiment of the invention will now be described, by way of example only, and with reference to the accompanying drawings, in which.

DETAILED DESCRIPTION OF EXEMPLARY EMBODIMENTS

Figure 1:
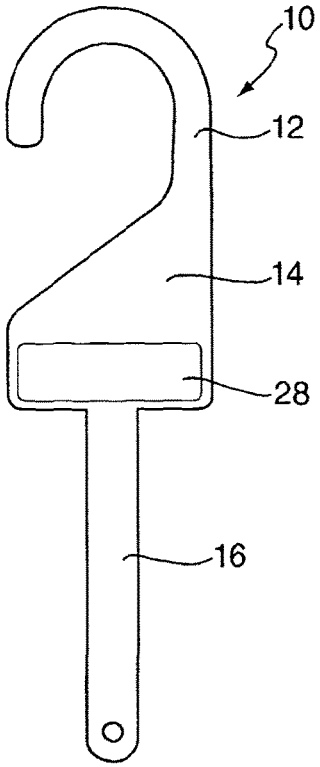
FIG. 1 shows a front view of a hanger according to the present invention.
Figure 2:
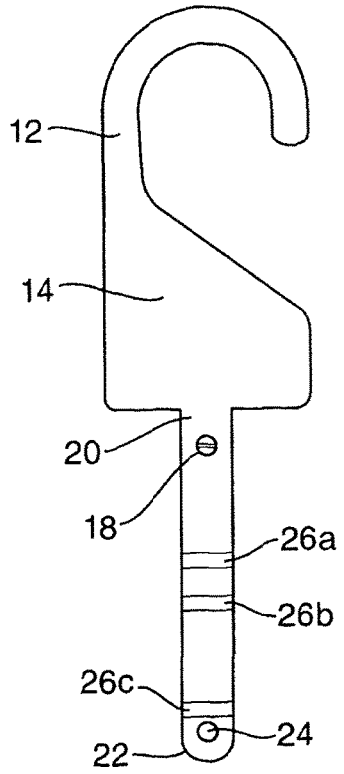
FIG. 2 shows a back view of the hanger of FIG. 1.
Figure 3:
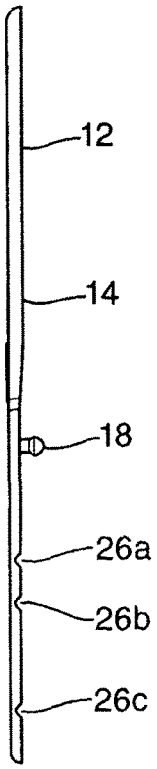
FIG. 3 shows a side view of the hanger of FIG. 1.

FIGS. 1 to 6 show a hanger 10 having a hook portion 12 connected to an intended upper end of a body portion 14, and an elongate member 16 connected to an intended lower end of the body portion 14. The length of the elongate member 16 is approximately the same as the length of the combined body portion 14 and hook portion 12. The elongate member 16 has a male part of a one-way "snap-fit" connector 18 at the end 20, nearest the body portion 14. The end 22 farthest from the body 10 of the elongate member 16 has an aperture 24, which is designed to cooperate with the "one-way" snap-fit connector 18. The elongate member 16 is weakened in a transverse direction in three positions 26*a*, 26*b* and 26*c*. The hanger 10 further comprises a region 28 on the body portion 14 on which a logo or identifying means can be printed or written. The hanger 10 is beveled at both the end of the hook portion 12 and the end of the elongate member 16. The hanger 10 is constructed from a plastics material.

Figure 4:
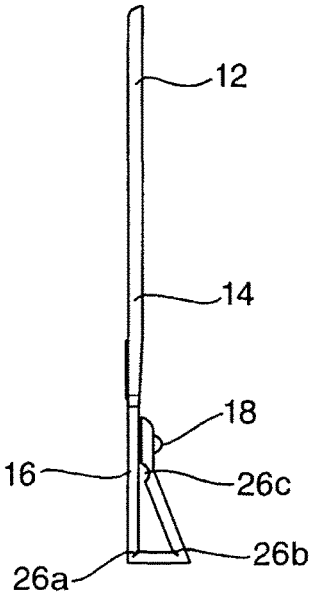
FIG. 4 shows a side view of the hanger of FIG. 1, when in use.

When in use, the elongate member 16 of the hanger 10 is threaded through a belt-loop of a pair of jeans (not shown). As shown in FIG. 4, the elongate member 16 is then folded inwardly at weakened positions 26*a* and 26*b* and outwardly at 26*c*, so that the aperture 24 is in line with the connector 18. The Section between weakened positions 26*a* and 26*b* defines a flat spacer 27. The aperture 24 is pushed onto and engages the male snap-fit connector 18. The male snap-fit connector 18 yields while the aperture 24 is pushed onto it due to the split in the top of the snap-fit connector 18. Once the aperture 24 has passed over the snap-fit connector, the plastics material returns to its original position and the aperture 24 is prevented from passing back over the snap fit connector 18. Therefore, the aperture 24 and the snap-fit connector 18 make a non-releasable connection such that the jeans are held securely on the hanger 10 and the "loop" formed by the elongate member 16 hanger cannot be readily uncoupled. The hook portion 12 of the hanger 10 can then engage a hanging rail (not shown), with the item to be hung resting upon the spacer 27.

To remove the item from the hanger 10, the elongate member 16 must be cut, preferably along one of the weakened regions 26A 26*b* 26*c*.

Figure 5:
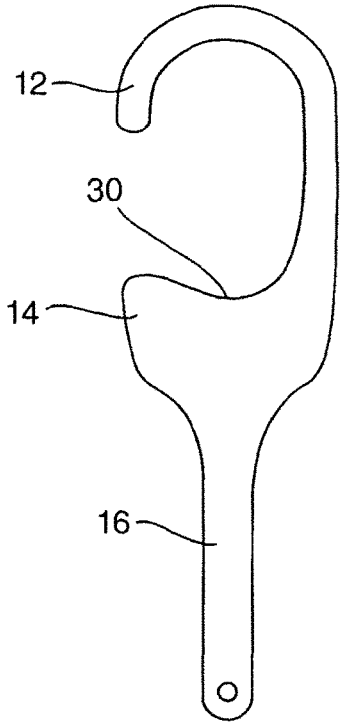
FIG. 5 shows a second embodiment of the present invention.

FIG. 5 shows a hanger 10 having the features shown in the first embodiment in FIGS. 1 to 4, with the additional feature of a recessed area 30 of the body 14 opposite the arc of the hook portion 12. When in use, the hook portion 12 engages a rail and the recessed area 30 reduces the risk of inadvertent disengagement of the hanger 10. When the hanger 10 is raised in order to be disengaged from the rail (not show), the user must draw the hanger 10 away from the rail in order to effect disengagement. If the user does not draw the hanger 10 away from the rail and continues raising the hanger 10, the recessed area 30 will engage the rail and make it more difficult to remove the hanger 10 from the rail. Therefore, if the hanger 10 is unintentionally raised with respect to the rail, recessed area 30 will reduce the risk of disengagement of the hanger 10.

Figure 6:
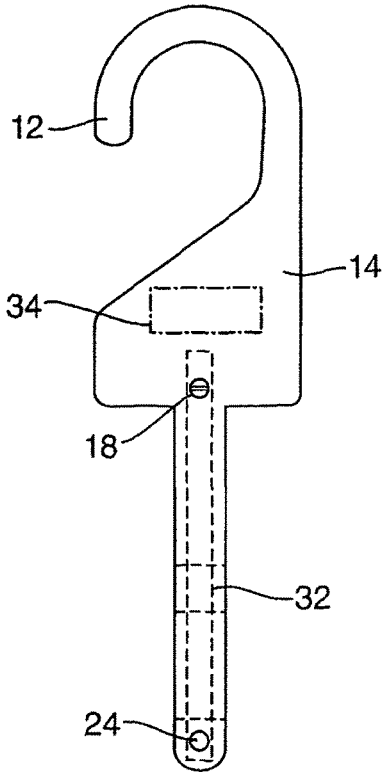
FIG. 6 shows a front view of a third embodiment of the present invention.

FIG. 6 shows a further embodiment of the present invention, wherein a split snap-fit connector 18 is positioned on the body portion 14 of the hanger 10. In this embodiment, a loop of metallic wire 32 is provided within the hanger 10 to reduce the likelihood of the hanger being easily removed from the item to which it is attached.

In order to remove the hanger 10 from the item to which it is attached, a removal device (not shown), such as a guillotine, is used to cut the plastics material, preferably at 26*a* or 26*b*, allowing the hanger 10 to be removed from the item. Alternatively, the removal device may melt the plastics material of the hanger 10 and any reinforcement material so that the hanger 10 can be removed from the item. The removal device may be mounted to a surface near a cashier's desk so that once an item has been paid for, the hanger 10 and integral security device can be removed prior to the customer leaving the store. By using a surface mounted device for the removal of the hanger, the likelihood of a thief removing the hanger in-store is reduced.

As shown in FIG. 6, a security tag 34 is moulded into the hanger during manufacture and is wholly embedded within the body portion, thereby sealing it within the hanger.

The connector 18 shown in the Figures may be releasable, or "two-way", rather than unreleasable. The hanger can then be reused and is suitable for use domestically. Where the connector 18 is a releasable connector, the item is removed from the hanger by releasing the connection and removing the elongate member 16 from the item.

Variations and modifications to the illustrated construction may occur to the reader familiar with the art without taking the device outside the scope of the present invention.

The hook portion 12 may be replaced with a closed aperture so that the hanger can be threaded onto a rail and retained on the rail. Such a construction may be useful in a hotel, where clothes hangers are often retained on a hanging rail to prevent theft of the hangers.

The body portion 14 may comprise a magnetic portion, either in addition to or in place of the region 28, so that a metal plate can be attached to the hanger 10. The magnetic plate may contain a name, address, or an identifying number. Such a construction may be useful for identifying garments, for example coats in a cloakroom or garments in a dry cleaner. Alternatively, a magnetic plate may be used on a metal hanger. This allows items to be identified quickly and easily from a rail and is more easily read than a label attached to the hanger either by sticky tape or string.

Other connection members may be used in place of a snap-fit connector, for example, a hook and eye fastener, a "popper", a button and hole, etc.

The wire in FIG. 6 of may be a length that passes from the snap-fit connection member 18 to the aperture 24, rather than a loop. This maintains the resistance of the elongate member against being cut, but requires a shorter length of wire.

"Loop" is intended to mean a closed circuit but not necessarily a circle.

"Electronic article surveillance" (EAS) is terminology used in the art of security devices. EAS is a technological method for preventing shoplifting from retail stores or other establishments whereby tags are fixed to merchandise and/or objects. The tags are removed or deactivated by the staff upon the item being properly bought or checked out. At the exits of the establishment, a detection system sounds an alarm or otherwise alerts a member of staff when active tags pass through.

The invention claimed is:

1. A method of hanging jeans, trousers or shorts using a hanger that includes a support-engaging upper hook forming section having a downwardly opening internal bight, and a lower body section, the lower body section having an upper portion and an elongate portion depending from the upper portion, the elongate portion having a uniform width defined by straight edges of the elongate portion, which width is less than the widest portion of the downwardly opening internal bight of the upper hook section and being deformable back upon itself to form a loop, the elongate portion having a first connection device at its distal end for connecting with a second connection device at the proximal end of the elongate portion or at the upper portion to hold the elongate portion in the form of a loop, and wherein the first connection device is provided on a distal end section of the elongate portion that is joined to an adjacent distal portion of the elongate portion by a weakened region that allows the distal end section to be brought into parallel relationship with the proximal end of the elongate portion or the upper portion thereby to reduce bending forces from otherwise acting on the connection devices;

the method comprising the steps of:

threading the elongate portion of the hanger through a belt loop of flexible material connected to the jeans, trousers or shorts;

deforming the elongate portion back upon itself to form a loop;

releasably attaching the first connection device to the second connection device; and using the support-engaging upper hook forming section to hang the garment.

2. A hanger for hanging an item, comprising a support-engaging portion and a deformable elongate member of uniform width defined by straight edges of the elongate portion, the support-engaging portion defining at least an aperture for receiving a support for hanging the device, and the elongate member extending from the support-engaging portion to a distal end of the elongate member, the elongate member comprising a connection mechanism such that the elongate member can be deformed back upon itself and connected to at least one of the support-engaging portion or the elongate member to form a loop, and wherein the elongate member is provided with three transversely extending weakened regions that are longitudinally spaced apart along the length of the elongate member such that when the elongate member is folded at the weakened regions, the elongate member can be formed into the shape of a triangle with a distal side of the triangle extending perpendicularly to a planar extent of the support engaging portion, each weakened region being defined by a groove that extends the entire width of the elongated member at the groove.

3. The device of claim 2, wherein a side of the triangular shape loop other than the distal side is coplanar with the support engaging portion.

* * * * *